US012656073B1

(12) United States Patent
Padget

(10) Patent No.: US 12,656,073 B1
(45) Date of Patent: Jun. 16, 2026

(54) MAGAZINE LOCK FOR A FIREARM

(71) Applicant: Martin Jay Padget, Carlsbad, CA (US)

(72) Inventor: Martin Jay Padget, Carlsbad, CA (US)

( * ) Notice: Subject to any disclaimer, the term of this patent is extended or adjusted under 35 U.S.C. 154(b) by 0 days.

(21) Appl. No.: 19/208,584

(22) Filed: May 15, 2025

(51) Int. Cl.
*F41A 17/38* (2006.01)

(52) U.S. Cl.
CPC ..... *F41A 17/38* (2013.01)

(58) Field of Classification Search
CPC ..... F41A 17/38
See application file for complete search history.

(56) References Cited

U.S. PATENT DOCUMENTS 10,132,584 B2 * 11/2018 Abbott ..... F41A 17/38
10,330,406 B2 * 6/2019 Christensen ..... F41A 17/38

* cited by examiner

*Primary Examiner* — Reginald S Tillman, Jr.

(57) ABSTRACT

Disclosed is an improved magazine lock, a first embodiment having a magazine catch with a relief communicating with the magazine well on the lower receiver of an assault weapon. This embodiment also uses a removable key, only accessible when the rifle is rendered inoperable, that interfaces with that relief to prevent the magazine from being expelled from the rifle. In a second embodiment, the key is disengaged from the catch by separating the lower and upper receivers from each other, while it is engaged by closing them against each other. The key is only accessible when the receivers are separated. In a third embodiment, the key is mechanized and operates as a selector switch to change between fixed magazine and non-fixed magazine operation for the rifle. The switch is only accessible when the rifle is rendered inoperable. Variations of and modifications to these embodiments are also presented.

21 Claims, 9 Drawing Sheets

FIG.10
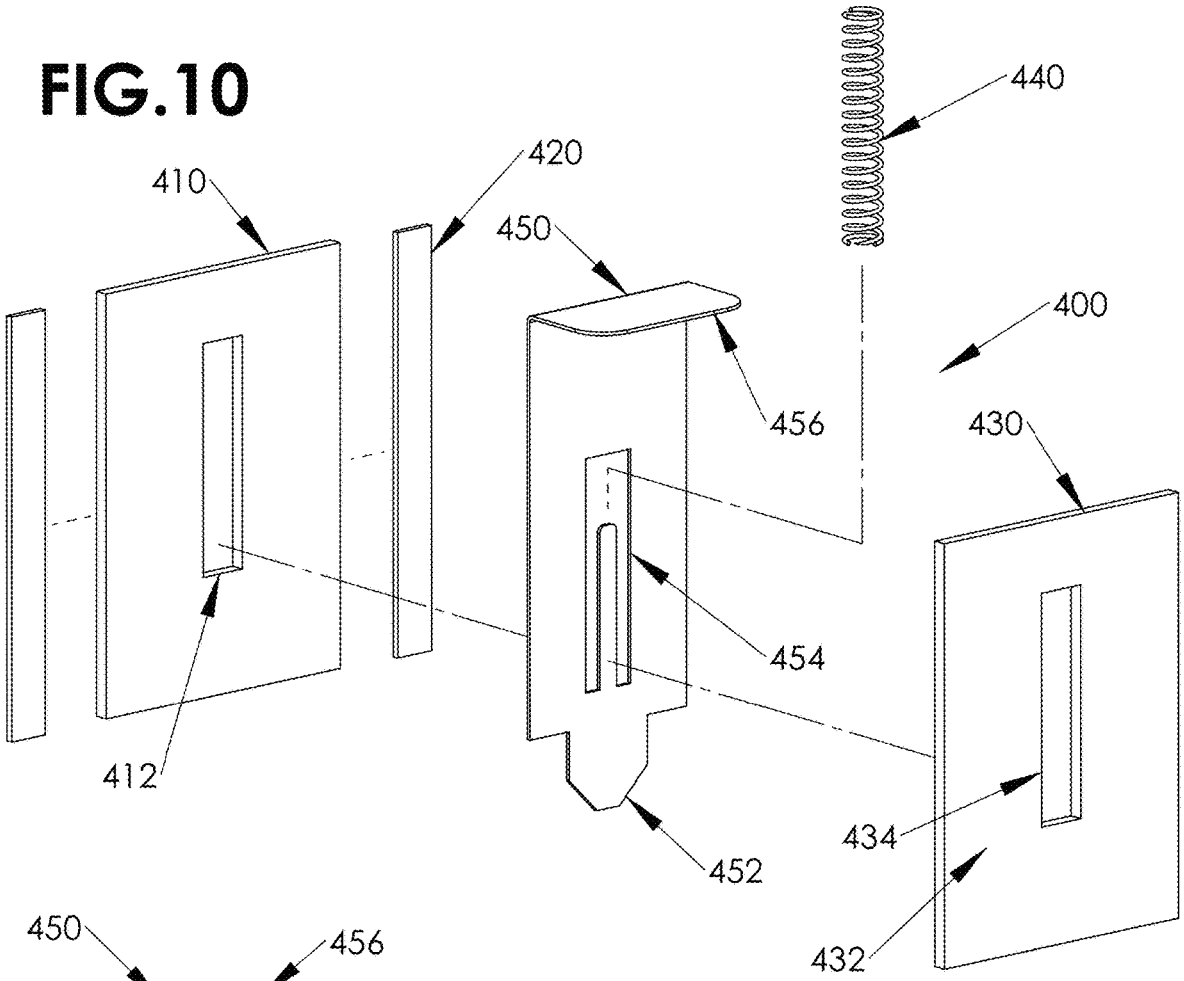
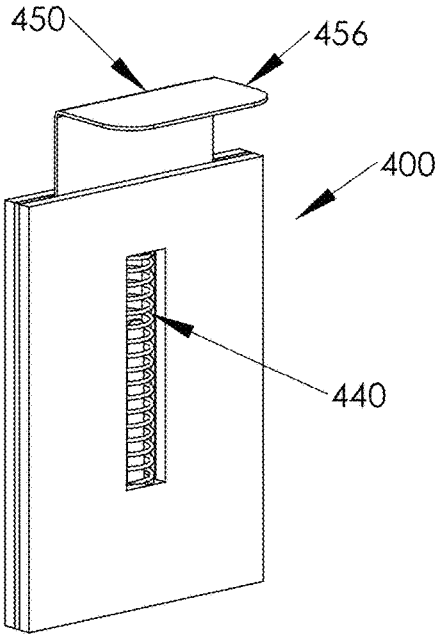
FIG.11
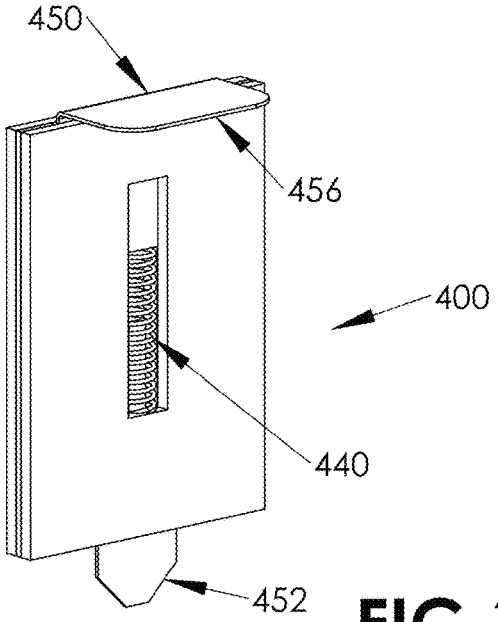
FIG.12

MAGAZINE LOCK FOR A FIREARM

PRIOR ART

| Patent Number | Kind Code | Issued/Pub Date | Patentee |
|---|---|---|---|
| 8,756,845 | B2 | 6/2014 | Harris et al. |
| 9,010,004 | B1 | 4/2015 | Fu |
| 9,182,186 | B1 | 11/2015 | Prince |
| 9,395,130 | B2 | 7/2016 | Jacobson |
| 9,482,478 | B2 | 11/2016 | Newman |
| 9,651,327 | B2 | 5/2017 | Hoon |
| 9,777,977 | B1 | 10/2017 | Makaron |
| 10,066,888 | B2 | 9/2018 | Chang et al. |
| 10,094,632 | B2 | 10/2018 | Blakey et al. |
| 10,132,584 | B2 | 11/2018 | Abbott et al. |
| 10,151,548 | B2 | 12/2018 | Cross |
| 10,228,205 | B2 | 3/2019 | Quinn et al. |
| 10,302,381 | B1 | 5/2019 | Huang |
| 10,330,406 | B2 | 6/2019 | Christensen |
| 12,235,060 | B2 | 2/2025 | Schoenfeld |
| 2018/0180369 | A1 | 6/2018 | Pappas et al. |

An additional example of prior art was found, however the manufacturer of this device only lists it as patent pending and the patent application for this device could not be located.

According to the reviews for the device as shown on the manufacture's website, its has been on the market since at least 2018. See https://maglatchusa.com/ar-15-f-n-g-r-fixed-magazine-kit/for more details.

BACKGROUND OF THE INVENTION

The present application is related to magazine lock devices for use on certain types of rifles that are classified as assault weapons by some US states, such as California. In these jurisdictions, having a fixed magazine on such a weapon may make it legal for private ownership. By locking the magazine in place, the weapon is then seen as having a fixed magazine in the legal sense. This fixing, or locking, of the magazine typically has to be done in a way that requires that the rifle first be rendered inoperable in order to remove the magazine. Moving the lower and upper receiver assemblies apart, separating them, on such weapons is one popular way to render the rifle inoperable in the legal sense.

The AR-15 style rifles are popular assault weapons that are often subject to these legal restrictions, though there are many other rifles and modular rifle platforms that are also classified as assault rifles under the law. While the AR-15 platform will be typically used as the example for discussions herein, it should be understood that the invention disclosed in this application, and the prior art presented herein, may have utility with many of these other firearms.

There are currently a number of ways of locking a magazine in place on such rifles that are interesting from the standpoint of prior art for this application.

A patent of interest is 10,132,584 (Abbott) where the magazine catch is fitted with a small detent which must be actuated for the magazine to be released. In this patent, the detent is only accessible once the upper and lower receivers are separated and an external tool is required to operate the detent due to its location down in the magazine well. While this mechanism is sleeker than many described below, the use of a separate tool to operate it is a serious drawback as it needs to be located and manipulated to restore the firearm to a compliant state. Furthermore, a lost tool would prevent removing the magazine altogether. Also, it can be some effort to put the rifle back in a stock condition as the magazine catch would need to be swapped out.

Similarly, a second device of interest is the F.N.G.R. Fixed Magazine Kit sold by MagLatch at maglatchusa.com. Since the patent application for this device could not be found and the device is currently only listed as patent pending by the manufacturer, inferences must be made about this invention from the details offered by the manufacturer. Like the previous example, this device uses a modified magazine catch and a second part located in the magazine well to lock the magazine in place. This key, that blocks the magazine catch from moving preventing the magazine from being ejected, appears to use the upper receiver to keep itself in place in its most basic embodiment. While this design is interesting and likely functions reasonably well, it also has some significant drawbacks. First, the device can only be removed by opening the firearm's action and then flipping the firearm upside down so that the key drops out of the firearm. This odd manipulation will likely result in dropped and lost keys in the field. Second, since these keys are not attached or mounted to the firearm in any way, they must be stored when not in use which can also lead to misplaced parts and an inability to restore the firearm to a fixed magazine complaint state. Third, when restoring the firearm to a compliant state, the key must first be located to be installed which takes additional time as this is no better than requiring a tool to complete this task.

Of all the prior art presented here, the Abbott patent and the F.N.G.R. device are mechanically most like what is disclosed in this patent application. However, there are important differences with and advantages of the invention disclosed herein that will become apparent.

Another group of mechanisms use an enlarged, specially shaped, and/or mechanized magazine release buttons that cannot be operated without there being some amount of separation between the upper and lower receivers. Examples of these mechanisms can be found in U.S. Pat. No. 8,756,845 (Harris), U.S. Pat. No. 9,182,186 (Prince), U.S. Pat. No. 9,777,977 (Makaron) U.S. Pat. No. 10,094,632 (Blakey), and U.S. Pat. No. 10,151,548 (Cross). These devices, while known to work reasonably well, have several drawbacks. First, they can be complex and they can protrude and/or differ substantially from the stock version of the weapon. Both of these can lead to reliability and operational problems. Second, they can be difficult to remove from a weapon should the user wish to convert back to stock operation. Third, they can be quite expensive.

One group of prior art seeks to disable to the magazine catch entirely and U.S. Pat. No. 9,651,327 (Hoon) and 2018/0180369 (Pappas) are examples of this. In these cases the magazine catch is completely disabled and it is not able to be operated without removing or swapping parts out on the rifle itself. While these are simple, low cost mechanisms in both cases, the inability to remove the magazine without removing or replacing parts on the rifle is a severe handicap.

Though deemed insufficient for the current legal requirements today, at one point in time so called "bullet button" rifles were available for sale. These devices required an external tool to operate the magazine release button. An example of this in prior art is U.S. Pat. No. 9,010,004 (Fu).

Another way to meet the legal requirement is by creating a magazine that does not respond to the magazine catch being operated without some sort of additional action. In one case, the magazine is formed in such a way that it can only be removed from the rifle through the top of the lower receiver rather than through the bottom as is typically the case. U.S. Pat. No. 9,395,130 (Jacobson) is an example of this sort of design. In another, the magazine is itself fitted with a catch that can only be operated with the two receiver parts separated. U.S. Pat. No. 12,235,060 (Schoenfeld) is an example of this sort of mechanism.

There are also a host of designs that require that the lower receiver be machined or replaced with a new unit to function. While these designs can be very capable, both of these options are seen as highly undesirable since this represents a major change to the rifle not only in terms of physical parts and/or difficultly to install, but sometimes with the government as well as rifles are often serialized based on the serial number found on the lower receiver. Examples of such mechanisms in prior art are U.S. Pat. No. 9,482,478 (Newman), U.S. Pat. No. 10,066,888 (Chang), U.S. Pat. No. 10,228,205 (Quinn), U.S. Pat. No. 10,302,381 (Huang), and U.S. Pat. No. 10,330,406 (Christensen).

Each of the these methods has drawbacks. Many can be expensive, complex, cumbersome and/or difficult to install/remove. Some disable the rifle more than is necessary to be legally compliant while others require serious changes to the lower receiver of the rifle to be installed. A few do not even meet the legal requirements for turning the weapon into a legal fixed magazine rifle. However, all require the swapping out of components mounted to the rifle to return the rifle to a stock, that is non-fixed magazine, operating condition. All this is seen as less than ideal.

SUMMARY OF THE INVENTION

In view of these and other problems in the art, it is a general object of the present invention to provide a method and apparatus that allows for changing a rifle between fixed magazine and non-fixed magazine operation easily, within a few seconds, and without additional tools or separate parts that could be lost or mishandled.

It is a further object of the present invention that such a method and apparatus would have a reasonable selling price and simple installation process.

It is a further object of the present invention that such a method and apparatus would be compact and deviate little from the stock version of the rifle.

It is a further object of the present invention that such a method and apparatus would be simple and reliable.

It is a further object of the present invention that such a method and apparatus would be compatible with the many existing after-market magazine catches available, though modification of them may be necessary.

It is a further object of the present invention that such a method and apparatus would make an assault weapon to be in compliance with fixed magazine laws in the State of California, as well as in other states that have such laws.

A primary use for this invention would be as a way for an assault rifle, as defined by the State of California and certain other states, to be converted from stock operation, meaning the magazine is not fixed in the rifle, to fixed magazine operation in order to make the rifle legal to own in such states. At a minimum, the invention comprises:

a. a magazine catch having a recess for a key;
b. a key, residing in the magazine well of the rifle, that prevents operation of the magazine release when present or engaged;
c. access to the key dependent on the rifle first being rendered inoperable.

Additional features and functionalities may be included to separate the disclosed invention from prior art.

This section was meant to provide a general summary of the disclosure and is not a comprehensive recitation of its full scope, utility, or features.

These and other objects and advantages of the present invention, as well as the details of the illustrative embodiments, will become more fully understood from the following descriptions and drawings.

BRIEF DESCRIPTION OF DRAWINGS

The drawings described herein are for illustrative purposes of selected embodiments and modifications to these embodiments. They do not represent all possible implementations of the invention and are not intended to limit the scope of the present disclosure.

FIG. 10 is an exploded isometric view of a second embodiment of the invention.

FIG. 11 is an isometric view of a second embodiment of the invention shown in the disengaged or up state.

FIG. 12 is an isometric view of a second embodiment of the invention shown in the engaged or down state.

DETAILED DESCRIPTION OF THE INVENTION

Disclosed is a method and apparatus for fixing the magazine of an assault rifle, as defined by certain US states, so that it may be legal to own in states with firearms laws that require this. While the magazine lock invention is described herein as being applied to an AR-15 style rifle, it should not be inferred that this invention may only be applied to this particular type of rifle. It should also be stated that these other types of rifles may have parts similar to the AR-15 in terms of utility to this invention, but they may be referred to by different names or even have different functions.

First Embodiment—FIGS. 1 through 9

Figure 1:
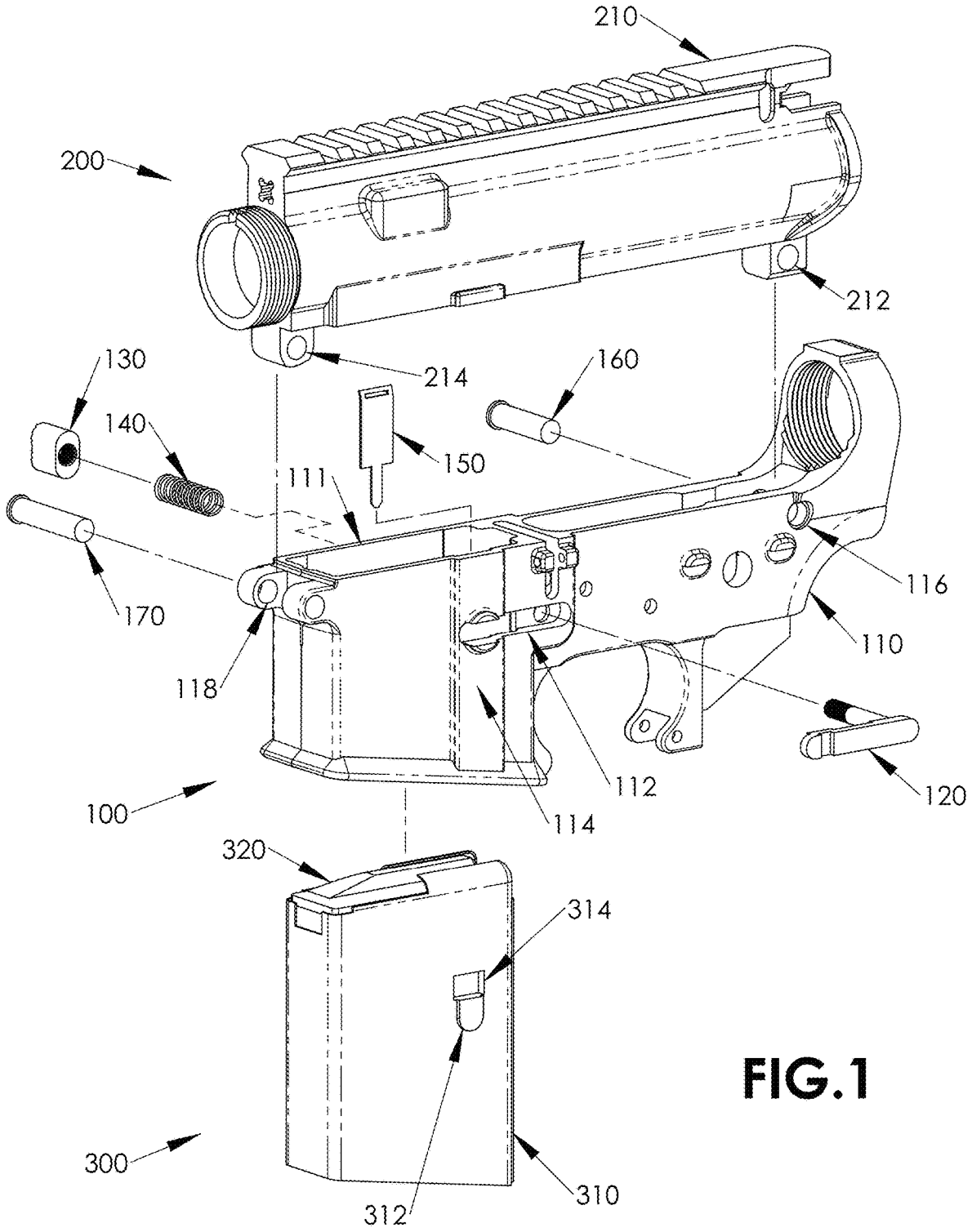
FIG. 1 is an exploded isometric view of a first embodiment of the invention along with the relevant parts of the lower and upper receivers as well as the magazine for an AR-15 type rifle.

FIG. 1 depicts a first embodiment of the invention, in an exploded format, so that the relevant parts of the rifle and invention may be described. Note that some parts normally found on an AR-15 rifle that are not relevant to this invention have been omitted for clarity.

The first major part is the lower receiver assembly (LRA) 100 and it is generally considered to be the core of the rifle. The LRA 100 is comprised of the lower receiver 110, having a magazine well 111, as well as the parts critical to retaining and releasing the magazine 300 including the magazine catch 120, which resides in the magazine catch slot 114, the magazine release button 130, and the magazine release spring 140. The rear takedown pin 160 and front pivot pin 170 and are also a part of the LRA 100 and are used to attach the upper receiver assembly (URA) 200 to the LRA 100 via holes 116 and 118 on the lower receiver itself.

The URA 200 is comprised of several parts, but of interest here is the upper receiver 210 with bores 212 and 214 that are meant to interface with the pins 160 and 170 to lock the URA 200 to the LRA 100.

The magazine 300 is the third critical assembly and it is comprised of several important parts and features including the magazine tube 310, which has the magazine stop 312 and the catch recess 314 on the exterior, as well as the follower 320 inside.

The key components and features for the disclosed invention are the lower receiver 110, with the magazine well sidewall 114, as well as the magazine catch 120 and the magazine catch key 150. The catch recess 314 on the magazine 300 is also of importance, as are the upper receiver 210, the pivot pin 170, and the takedown pin 160.

Figure 2:
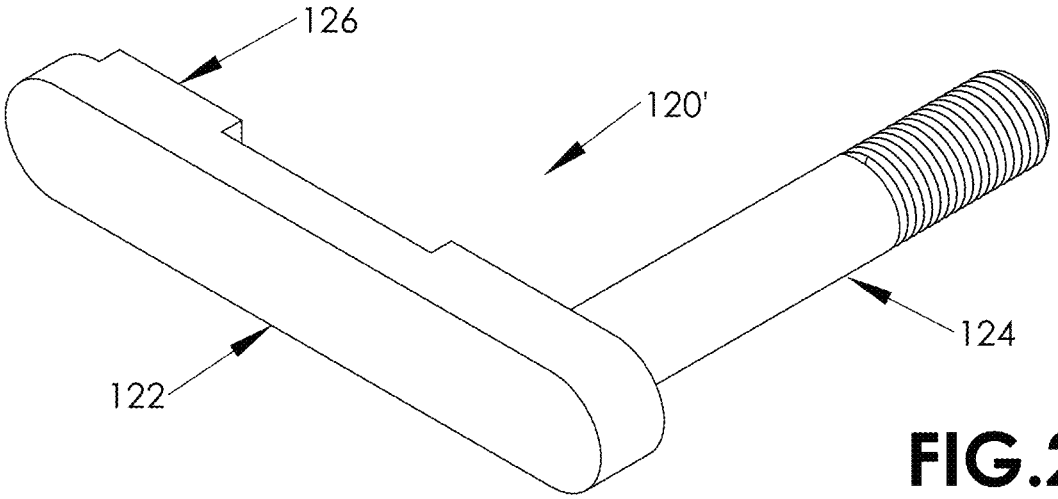
FIG. 2 is an isometric view of a typical magazine catch.

FIG. 2 shows a typical/stock magazine catch 120' with the catch body 122 and the button shaft 124. Attached to the body 122 is the catch pad 126 that is meant to interlock with the catch recess 314 on the magazine 300 to keep the magazine 300 properly located during operation.

Figure 3:
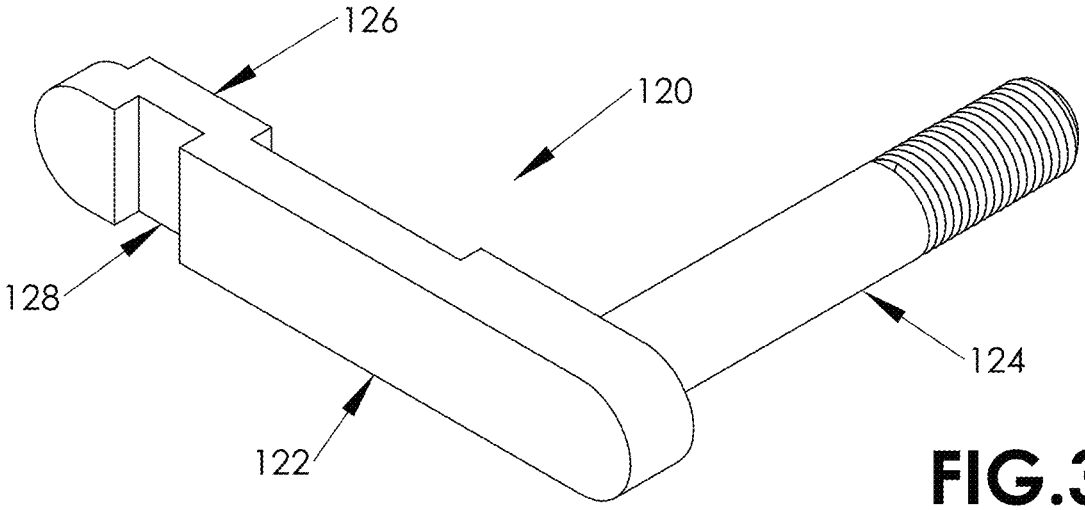
FIG. 3 is an isometric view of a modified magazine catch for use with this invention.

FIG. 3 depicts how a modified magazine catch 120 may be altered from stock to work with the disclosed invention with the addition of a slot/recess 128 typically being sufficient. This minor alteration should be compatible with most of the custom magazine catches currently on the market. If not, there are other options available that may work. Furthermore, in many variations of this component, the slot 128 is in direct communication with both the magazine well 111 and the exterior of the firearm. This feature is important so that the firearm may be recovered from a double feed jam, a problem with which other prior art designs typically struggle.

Figure 4:
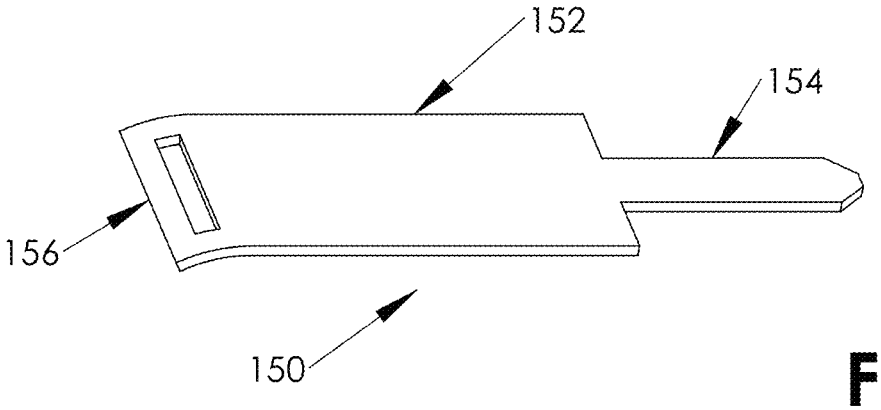
FIG. 4 is an isometric view of a magazine catch key for use with this invention.

FIG. 4 shows a magazine release key 150 for use with the disclosed invention. It may be comprised of a body 152, a tang 154, and a pull tab 156. The tang 154 in meant to fit within the recess 128 on the modified magazine catch 120. The key 150 is meant to be long enough to extend past the top of the lower receiver 110 when installed, allowing the key 150 to be manipulated directly by the operator.

Figure 5:
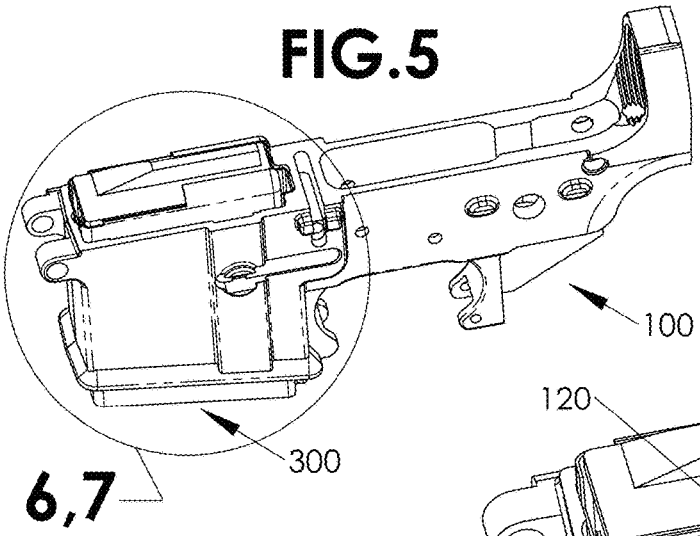
FIG. 5 is an isometric view of a first embodiment of the invention with relevant lower receiver parts and magazine used to setup FIG. 6 and FIG. 7.
Figure 5:
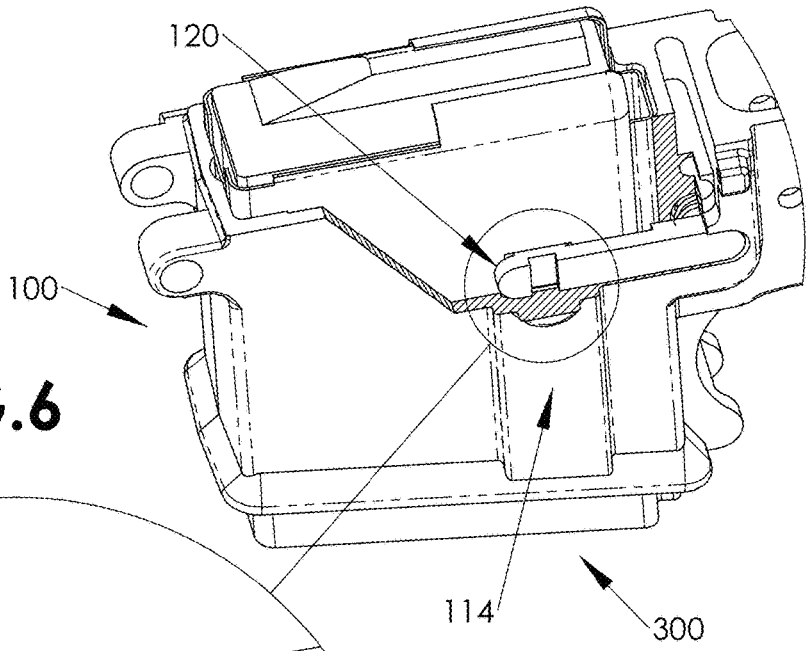
Figure 6:
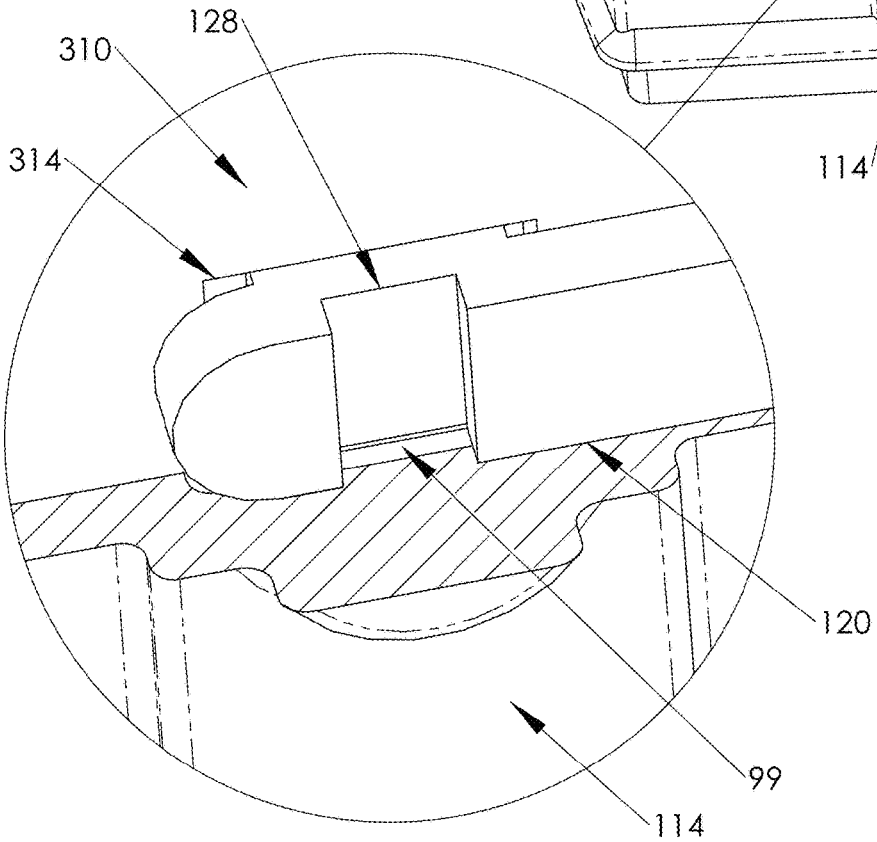
FIG. 6 is an isometric partial-section view, with detail break out, of a first embodiment of the invention taken from FIG. 5 highlighting the relationship between the magazine, the modified magazine catch, and the lower receiver, but without the magazine catch key.
Figure 7:
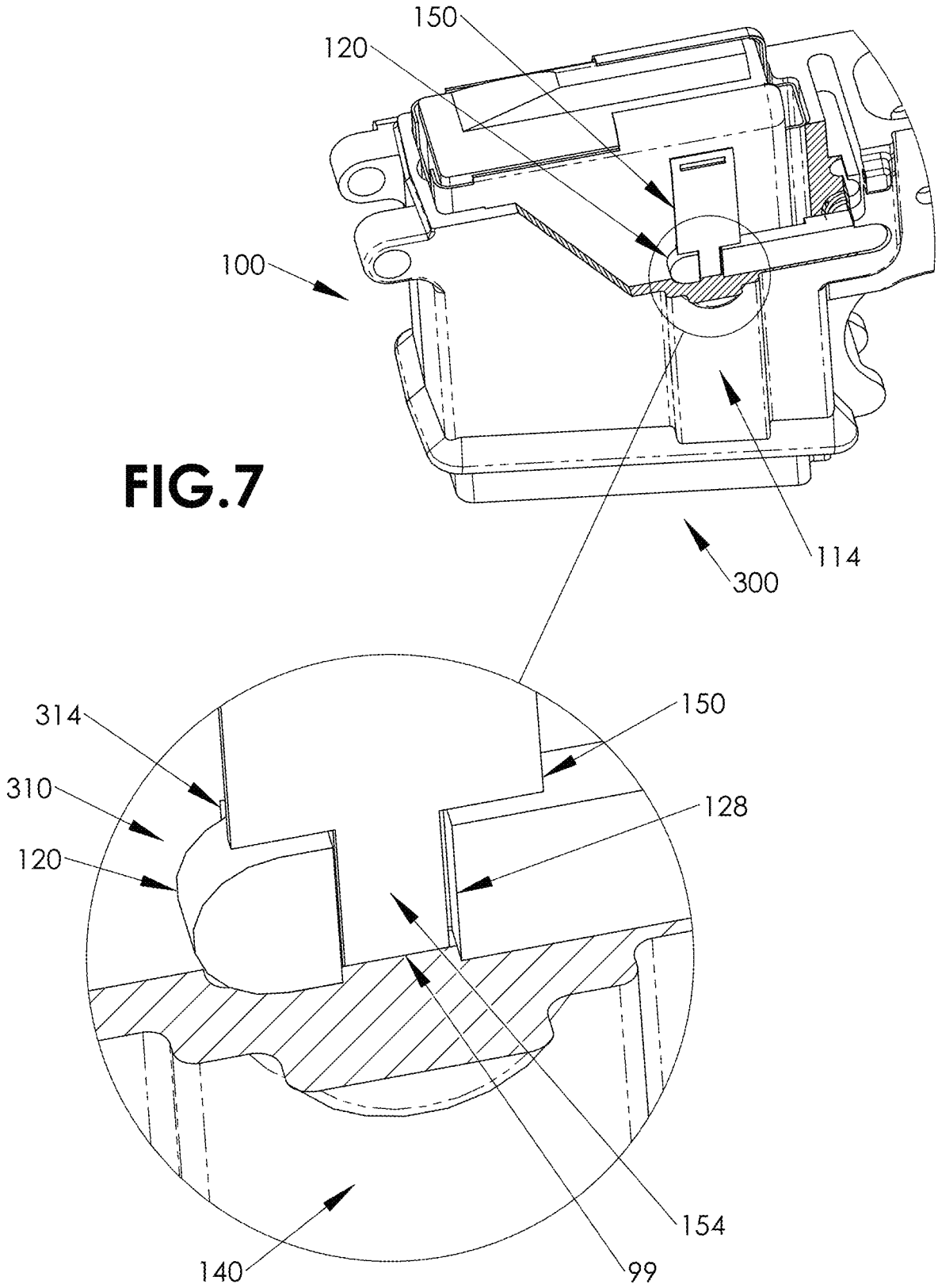
FIG. 7 is an isometric partial-section view, with detail break out, of a first embodiment of the invention taken from FIG. 5 highlighting the relationship between the magazine, the modified magazine catch, the lower receiver, and the magazine catch key.

FIG. 5 is used here to setup the view perspective for FIG. 6 and FIG. 7 and it shows the LRA 100 and the magazine 300.

FIG. 6 details the interplay of the features and parts of the disclosed invention on the LRA 100. In this figure, the magazine well sidewall 114 has been partially cutaway, as indicated by the hatching, to reveal important internals. Of primary importance here is the gap 99 created between the recess 128 on the magazine catch 120 and the magazine well sidewall 114 on the lower receiver 110.

FIG. 7 is very much like FIG. 6, but it shows how the tang 154 on the key 150 fits in the gap 99 described on FIG. 6 when the key 150 is installed. In doing so, the magazine catch 120 is prevented from moving outboard and past the magazine well sidewall 114 to release the magazine 300 from LRA 100. This is because the key 150 is trapped between the magazine catch 120 and the magazine well sidewall 114 on the lower receiver 110, blocking the magazine catch 120 from moving outward.

Figure 8:
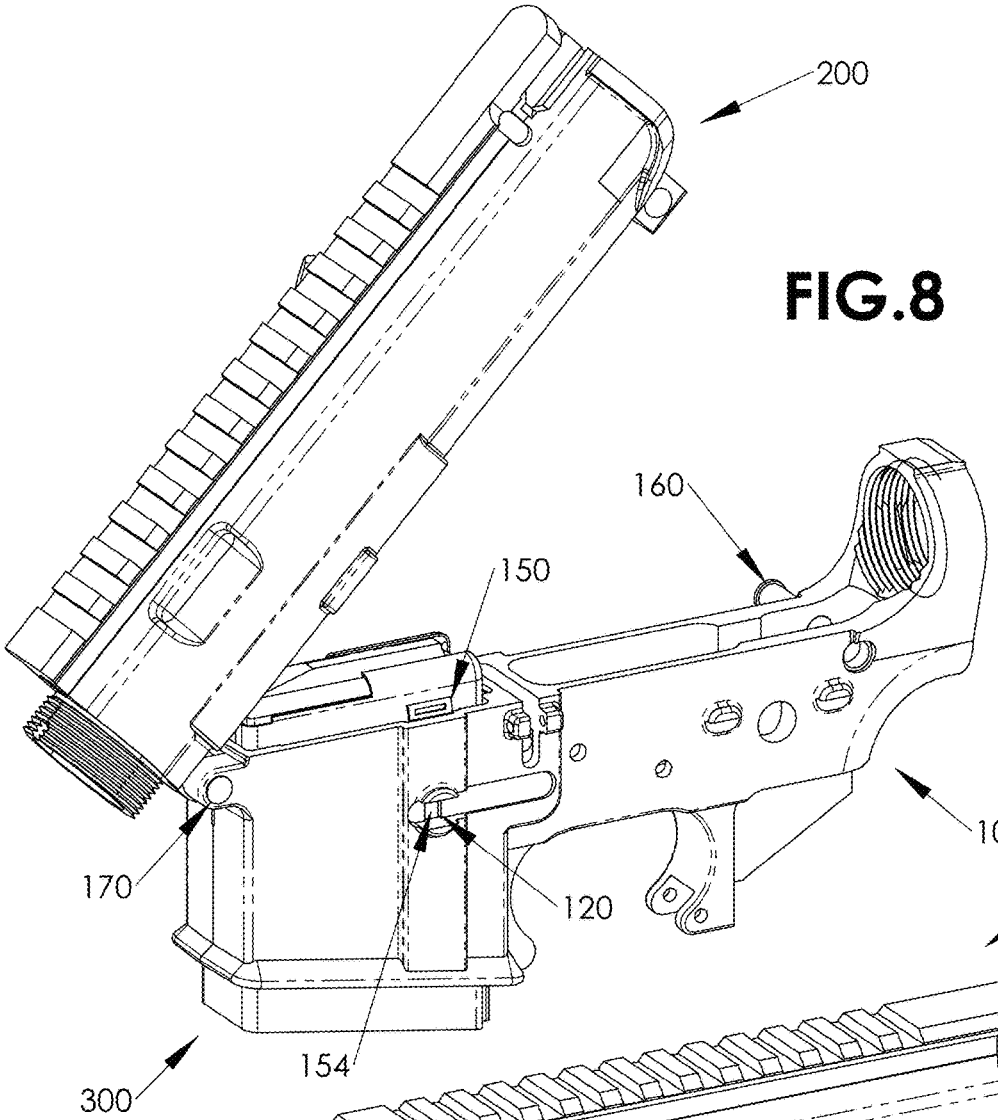
FIG. 8 is an isometric view of a first embodiment of the invention along with the relevant parts of the lower and upper receivers, including the magazine, for an AR-15 type rifle shown with the lower and upper receivers separated.
Figure 9:
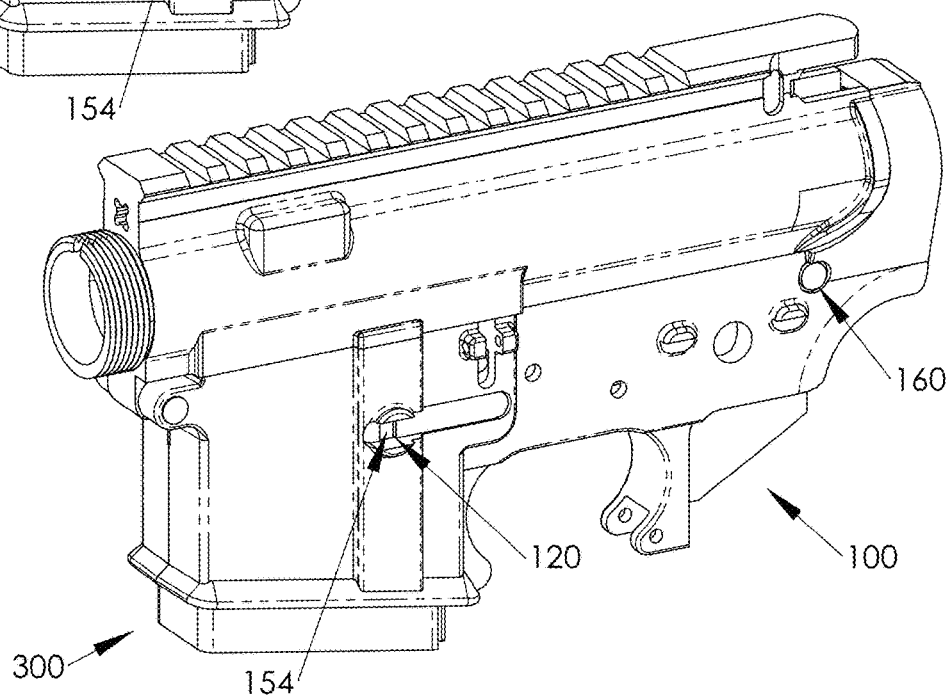
FIG. 9 is an isometric view of a first embodiment of the invention along with the relevant parts of the lower and upper receivers, including the magazine, for an AR-15 type rifle shown with the lower and upper receivers locked together as they would be during operation.

FIG. 8 and FIG. 9 show how the key 150 is contained between the LRA 100, the magazine 300, and the URA 200 during use, though the key 150 is substantially held in place by being wedged between the magazine well side wall 114 and the magazine 300. FIG. 8 depicts the URA 200 rotated around the front pivot pin 170 and the rifle in an inoperable state. Only in this inoperable state can the key 150 be accessed, manipulated, and/or removed to allow the magazine 300 to be expelled by use the of the magazine release button 130 and magazine catch 120. When in place, the key 150 extends above the lower receiver 110 which allows the key 150 to be directly removed or manipulated by the operator with the firearm in its normal orientation. FIG. 9 shows the URA 200 and the LRA 100 together and pinned in place via the rear takedown pin 160. This is the operable state for the rifle and it should be noted that the key 150 cannot be accessed, manipulated, and/or removed, and thus, the magazine 300 cannot be released. With the key 150 installed in the rifle and the URA 200 fully in place against the LRA 100, the rifle can be said to have a fixed magazine since the magazine 300 cannot be easily removed without separating the URA 200 and LRA 100 to remove the key 150.

Second Embodiment—FIGS. 10 through 13

FIG. 10 is an exploded view of a second embodiment of the disclosed invention. This device 400 is comprised of the rear plate 410, one or more spacers 420, the key 450, the spring 440, and the front plate 430. Windows 412 and 434 on the rear 410 and front 430 plates allow clearance for the spring 400, should it be required. The front plate 430 would likely have some sort of adhesive 432 applied to its exterior that would be exposed for installation. The key 450 has a tang 452 similar to the first embodiment, but it also contains a feature 454 to mount the spring 440, as well as a tab 456 at the top of the key 450. Like the previous embodiment, the key 450 extends above the lower receiver 110, allowing the key 450 to be directly manipulated by the operator of the firearm when the firearm's action is open.

FIG. 11 shows the device of this second embodiment in the disengaged, or up, state where the spring 440 is extended and the tang 452 (not shown) is retracted. This condition is achieved by removing any downward force or constraint on the tab 456. In this condition, the tang 452 would not be engaged with the magazine catch 120 (not shown) if this device 400 were installed into a rifle, allowing the magazine 300 to be ejected from the rifle.

FIG. 12 shows the device of this second embodiment in the engaged, or down, state where the spring 440 is compressed and the tang 452 is extended downward. This state is achieved by applying a downward force or constraint on the key 450 via the tab 456. This happens because tab 456 is clamped between the URA 200 and LRA 100 as they are closed against one another. In this condition, the tang 452 would be engaged with the magazine catch 120 (not shown) if this device 400 were installed into a rifle. In this condition, the magazine 300 is fixed and cannot be removed from the rifle without first rendering the rifle inoperable.

Figure 13:
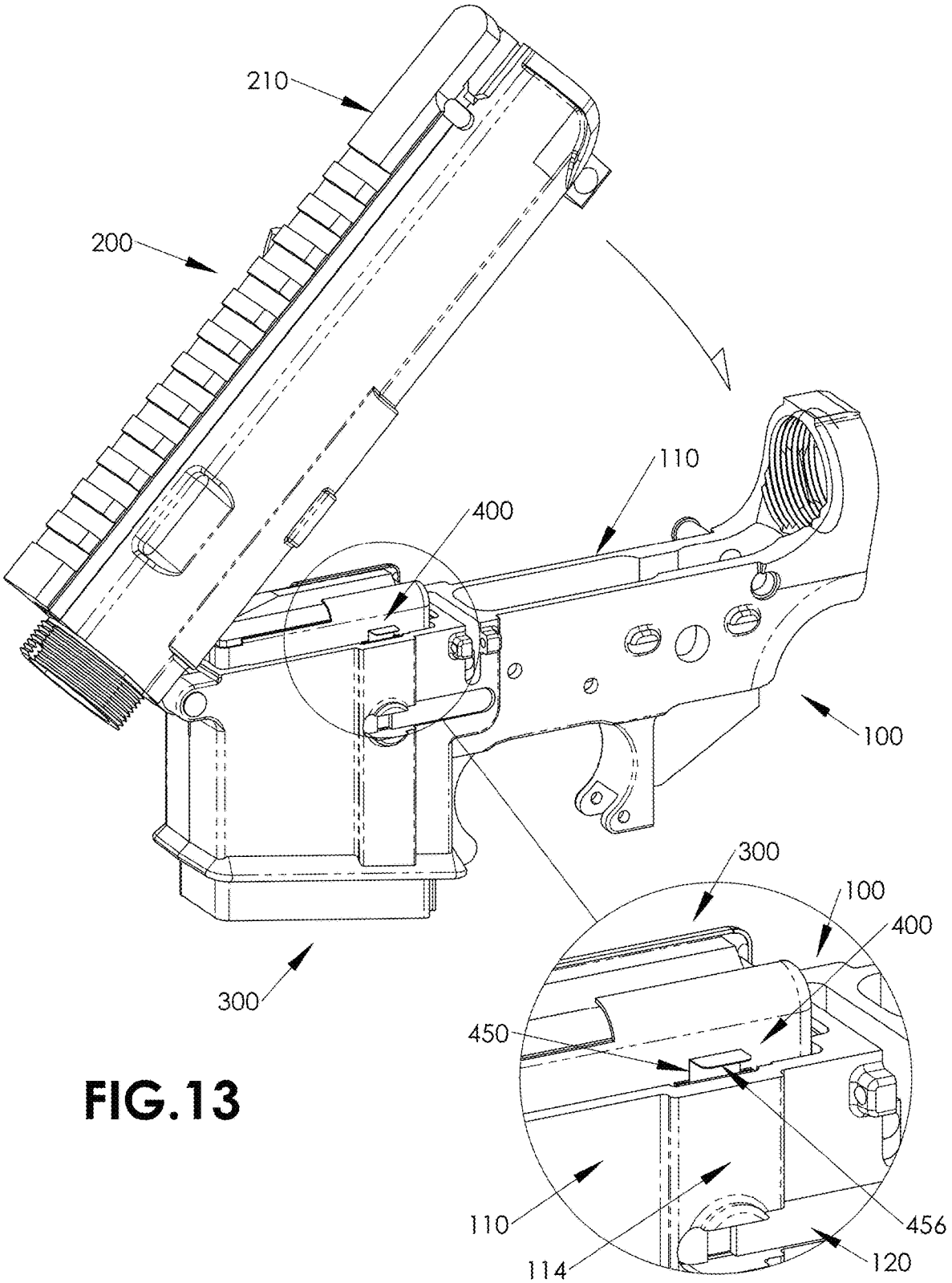
FIG. 13 is an isometric view of a second embodiment of the invention along with the relevant parts of the lower and upper receivers, including the magazine, for an AR-15 type rifle shown with the lower and upper receivers separated.

FIG. 13 depicts this second embodiment installed in a rifle. The device 400 would be glued in place on the inside of the magazine well sidewall 114 using the aforementioned adhesive 432 (not shown). Typically, the device will be adhered directly above the magazine catch 120 and the tab 456 would then be located some distance above the top of the lower receiver 110 when the URA 200 is separated from the LRA 100. In this up state, the tang 452 (not shown) on the key 450 is not engaged with the magazine catch 120 and will not impede the magazine release function of the rifle. Once the URA 200 and the LRA 100 are brought back together, the upper receiver 210 will push the key 450 towards the lower receiver 110 via tab 456. In doing so, the tang 452 (not shown) on the key 450 extends downward and engages with the magazine catch 120 in gap 99 (not shown), as with the first embodiment, which keeps the magazine catch 120 from moving. This prevents the magazine 300 from being dropped from the rifle, resulting in a fixed magazine condition. Separating the URA 200 and LRA 100 would then allow the key 450 to rise back up to disengage the tang 452 from the magazine catch 120. This would allow the magazine 300 to be dropped from the rifle via the magazine release button 130 (not shown).

This second embodiment could certainly be designed differently than is presented here without departing from the scope of the invention disclosed herein. For example, the spacers 420 could be removed and replaced by additional features added to the front plate 430 and/or rear plate 410. Or, it may be possible to design out one or both of the plates, 410 and/or 430, altogether, and/or the spacers 420 as well. Other examples would might include using different kinds of springs 440, mounting the spring 440 differently than shown, and/or employing a mounting strategy that used a different sort of adhesive 432 or even no adhesive at all. Furthermore, the tab 456 could be eliminated or altered to operate by interfacing with a different part of the upper receiver 210. It may even be possible to mount the key 450 to the upper receiver 210 and possibly eliminate the spring 440 altogether. In yet another variation, the key 450 might not even need a separate spring 440, or encasement by the plates 410, 430 and spacers 420. In this variation, the key 450 would be directly mounted to the lower receiver 110 and spring function would be designed into the key 450 itself.

Of course, this is not an exhaustive list of all the design variations that may be useful for this particular embodiment that would be understood by those skilled in the art. These variations would not result in a departure from the spirit and scope of this invention.

Third Embodiment—FIGS. 14 through 17

Figure 14:
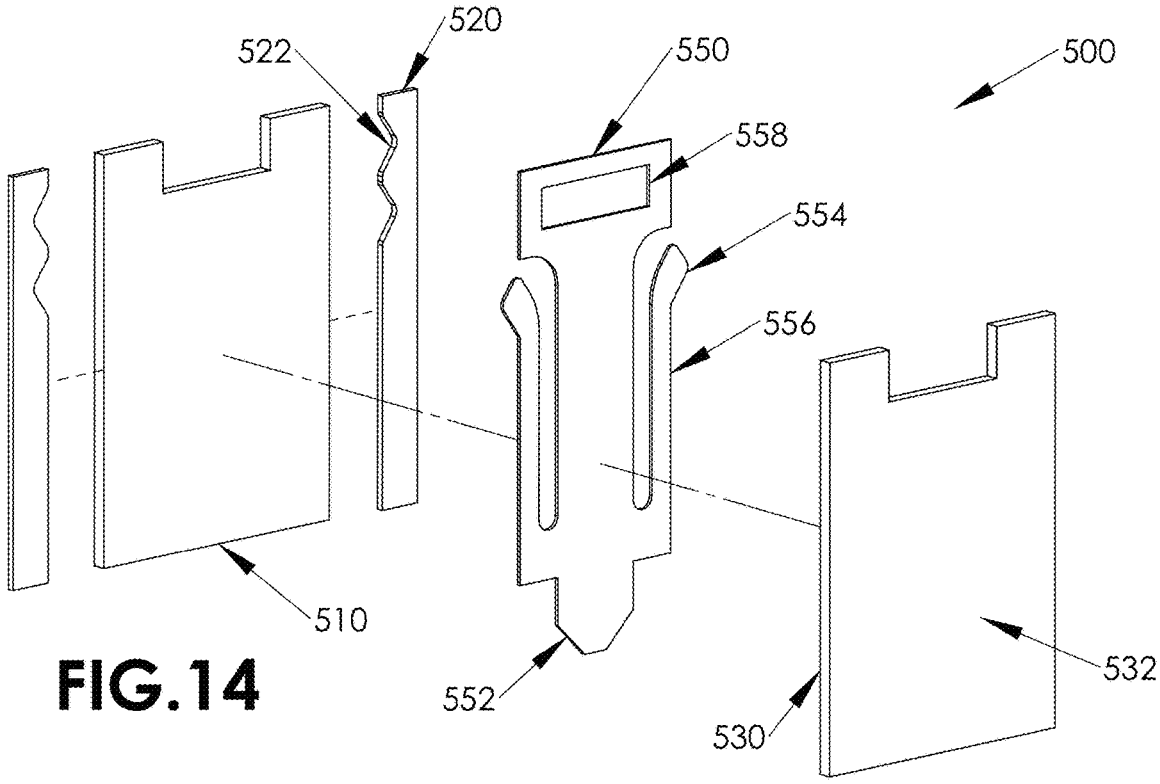
FIG. 14 is an exploded isometric view of a third embodiment of the invention.

FIG. 14 is an exploded view of a third embodiment of the disclosed invention. This device 500 is comprised of the rear plate 510, one or more spacers 520, the key 550, and the front plate 430. The front plate 530 would likely have some sort of adhesive 532 applied to its exterior that would be exposed for installation. The key 550 has a tang 552 similar to the other embodiments presented herein, but it also contains additional features. There are one or more detents 554 at the end of the spring arms 556, which are meant to engage with the valleys 522 on the spacers 520. Like the previous embodiments, the key 550 extends above the lower receiver 110, allowing the key 550 to be directly manipulated by the operator of the firearm when the firearm's action is open.

Figure 15:
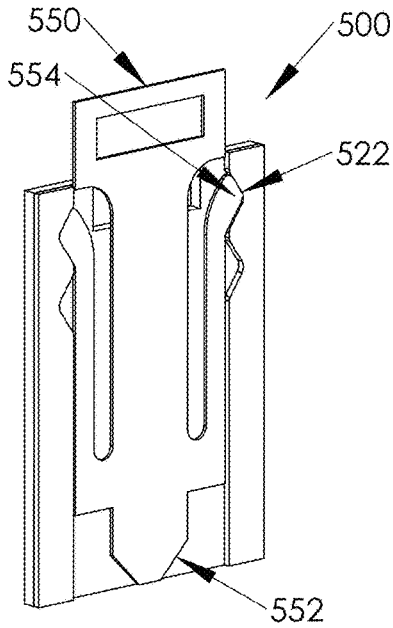
FIG. 15 is an isometric view of the internal operation of a third embodiment of the invention shown in the disengaged or up state.
Figure 16:
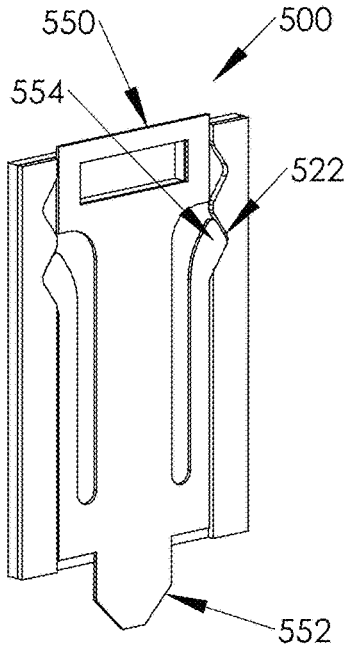
FIG. 16 is an isometric view of the internal operation of a third embodiment of the invention shown in the engaged or down state.

FIG. 15 shows this third embodiment with the front plate 530 removed so that the inner workings of the mechanism may be examined. In it, the key 550 is shown in the disengaged, or up, position with the tang 552 retracted and the detents 554 snapped into the top set of valleys 522 on the spacers 520. In this condition, the tang 552 would not be engaged with the magazine catch 120 (not shown) if the device 500 were installed into a rifle, allowing the magazine 300 to be ejected via the magazine release button 130 (not shown).

FIG. 16 again shows this third embodiment with the front plate 530 removed so that the inner workings of the mechanism may be examined. In it, the key 550 is shown in the engaged, or down, position with the tang 552 extended and the detents 554 snapped into the bottom set of the valleys 522 on the spacers 520. In this condition, the tang 552 would be engaged with the magazine catch 120 (not shown) if the device 500 were installed into a rifle, preventing the magazine 300 from being ejected without additional, complex steps.

Figure 17:
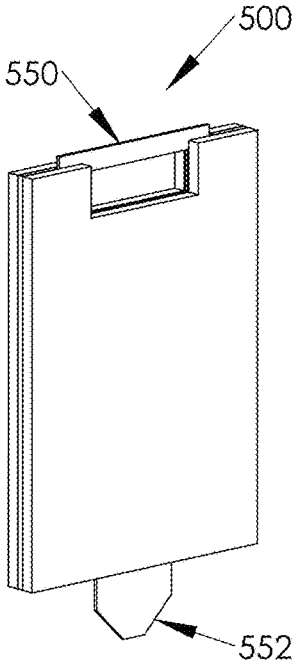
FIG. 17 is an isometric view of a third embodiment of the invention shown in the engaged or down state.
Figure 18:
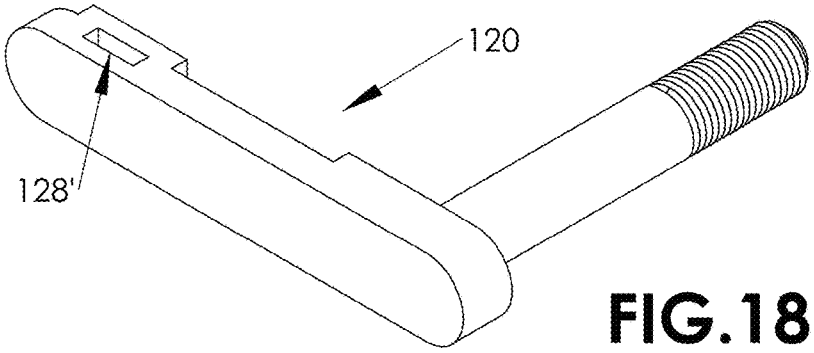
FIG. 18 is an isometric view of an alternative embodiment of the modified magazine catch.
Figure 19:
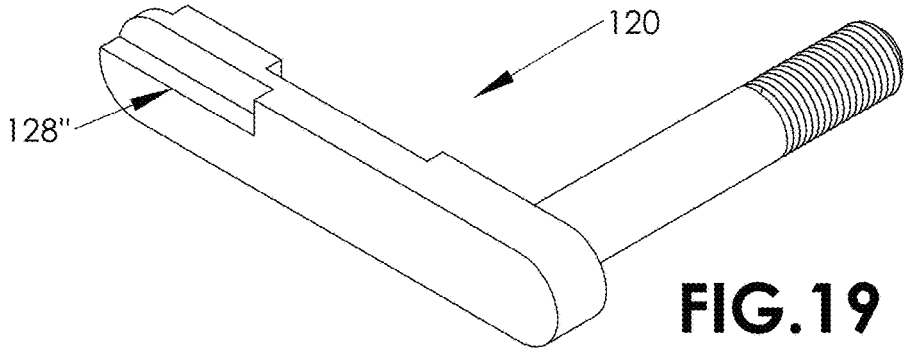
FIG. 19 is an isometric view of an alternative embodiment of the modified magazine catch.
Figure 20:
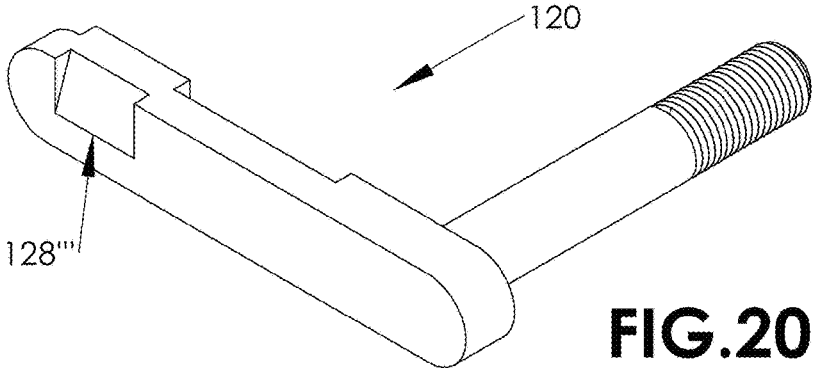
FIG. 20 is an isometric view of an alternative embodiment of the modified magazine catch.
Figure 21:
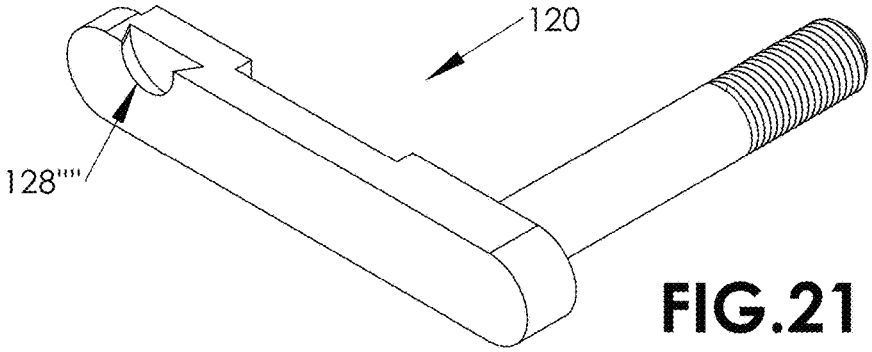
FIG. 21 is an isometric view of an alternative embodiment of the modified magazine catch.

FIG. 17 depicts the device 500 with the front plate 530 in place. It shows that that key 550 may be accessed in order to operate the mechanism.

This third embodiment 500 mounts to the rifle much like the second embodiment does and is shown in FIG. 13 and described herein. However, this device 500 is operated directly by the user of the rifle, as with the first embodiment, rather than automatically by the user enabling and disabling the rifle, as with the second. Because the key 550 never leaves the rifle, unlike the first embodiment, this device 500 effectively works as a selector switch to choose between fixed magazine and non-fixed magazine operation where the only way to access the switch is to disable the rifle by separating the URA 200 and the LRA 100.

While this embodiment has many of the same design choices, considerations, and variations that the second embodiment does, it has some others available that are worth mentioning. First, it is completely possible to build a device that works without the detents 554 as friction may be high enough to keep the key in its desired position in some circumstances. Similarly, the detents 554 could moved to a different part, like the rear plate 510.

It is also very possible to design this third embodiment to work with different types of motion rather than the linear, push/pull one depicted here. For example, one could build this device 500 to operate with a slider, lever, or thumb wheel to move the key 550 between the disengaged and engaged positions. Another possible variation would be to design the device 500 like a mechanical push button switch, with the device 500 changing between fixed magazine and non-fixed magazine operation with each press of the button. Moreover, the key 550 could be spring loaded to be either naturally up or naturally down, which also presents a number of interesting possibilities.

Again, this is not an exhaustive list of all the design variations that may be useful for this particular embodiment that would be understood by those skilled in the art but would not depart from the spirit and scope of the present invention

Modifications to the Embodiments—FIGS. 18 through 21

FIGS. 18 through 21 depict alternative ways to design the slot/recess 128'/128"/128'''/128'''' on the magazine catch 120. Each variation has its use, depending on how the overall mechanism is desired to operate. Some variations may be more manufacturable than others and therefore having a lower cost to produce. In many of the variations, the slot/recess 128"/128'''/128'''' is in direct communication with both the magazine well 111 and the exterior of the firearm. This feature is important so that the firearm maybe be recovered from a double feed jam, a problem with which other prior art designs typically struggle.

The keys shown in the prior embodiments, 150, 450 and 550, are each depicted as being designed as largely flat parts likely designed for sheet metal processes. This, however, need not not be the case. It is easy to envision this mechanism designed to work with the key made in a variety of ways including formed wire, ejection molding, or die casting. The main concept of the key 150/450/550 is that it impedes the movement of the magazine catch 120 as described in this application and that it can be directly manipulated by the operator.

One again, this is not an exhaustive list of all the design variations that may be useful for this disclosed invention that would be understood by those skilled in the art. These unlisted variations could be employed without departing from the spirit and scope of the present disclosed invention.

Utility, Applications, and Conclusion

The primary use foreseen for this invention is in its ability to easily convert a stock AR-15 rifle with a releasable magazine to have a fixed magazine in the legal sense. The ability to do this allows for such a rifle to be legal to own in states such as California which do not allow fully featured assault rifles to be owned by the general public. What sets this invention apart from others that seek to accomplish the same task is that a rifle outfitted with this invention can be converted back to stock operation, meaning the rifle's magazine is not fixed, in a matter of just a few seconds with no tools. In addition, there are no complicated external mechanisms that can get in the way during use or, worse, fail to operate correctly because of external forces. Another benefit of the invention is that it can be made inexpensively and installs very easily.

While the AR-15 is used as the primary example of a firearm on which this invention may be employed, it is expected that this novel device could be designed for and installed on other types of semi automatic rifles and assault weapons as well. Moreover, with minimal changes, this device can be made to work with nearly any after-market magazine catch.

While the present invention has been described with reference to presently preferred embodiments, it is to be understood that alterations may be made by a person skilled in the art without departing from the scope and spirit of the invention as set forth in the appended claims.

What is claimed is:

1. A magazine lock for a firearm, the firearm having a lower portion/receiver, the lower portion/receiver having a magazine well for corralling a magazine;

said magazine lock comprising:

a magazine catch extending into said magazine well, and having a relief in communication with the interior of said magazine well;

a key having a feature for fitting within said relief on said magazine catch, substantially fitting between said magazine well wall and said magazine, and extending above said lower portion/receiver;

whereby said key being present in said relief on said magazine catch prevents said magazine from being removed from said firearm;

whereby said key being absent from said relief on said magazine catch permits said magazine to be removed from said firearm.

2. The magazine lock of claim 1, wherein said magazine catch is has a relief on the outboard portion of said magazine catch, said relief being in direct communication with the exterior of said firearm and the interior of said magazine well.

3. The magazine lock of claim 1, wherein said key can be accessed and/or manipulated without the use of an external tool.

4. The magazine lock of claim 1, wherein said key can only be accessed and/or manipulated by rendering said firearm inoperable.

5. The magazine lock of claim 1, wherein said key is movably mounted to the interior of said magazine well.

6. The magazine lock of claim 5, wherein said magazine catch has a relief on the outboard portion of said magazine catch, said relief being in direct communication with the exterior of said firearm and the interior of said magazine well.

7. The magazine lock of claim 5, wherein said key can be accessed and/or manipulated without the use of an external tool.

8. The magazine lock of claim 5, wherein said key can only be accessed and/or manipulated by rendering said firearm inoperable.

9. The magazine lock of claim 5, wherein said key automatically disengages from said magazine catch by rendering said firearm inoperable.

10. The magazine lock of claim 5, wherein said key can be selectively placed in either an engaged state or in a disengaged state with said magazine catch.

11. A magazine lock for a firearm, the firearm having a lower portion/receiver, the lower portion/receiver having a magazine well for corralling a magazine;

said magazine lock comprising:

a magazine catch extending through the wall of and into said magazine well, and having a relief on the outboard portion of said magazine catch, said relief in direct communication with the exterior of said firearm and the interior of said magazine well;

a key having a feature for fitting within said relief on said magazine catch, and substantially fitting between said magazine well wall and said magazine;

whereby said key being present in said relief on said magazine catch prevents said magazine from being removed from said firearm;

whereby said key being absent from said relief on said magazine catch permits said magazine to be removed from said firearm.

12. The magazine lock of claim 11, wherein said key extends above said lower portion/receiver.

13. The magazine lock of claim 11, wherein said key can be accessed and/or manipulated without the use of an external tool.

14. The magazine lock of claim 11, wherein said key can only be accessed and/or manipulated by rendering said firearm inoperable.

15. The magazine lock of claim 11, wherein said key is movably mounted to the interior of said magazine well.

16. The magazine lock of claim 15, wherein said key extends above said lower portion/receiver.

17. The magazine lock of claim 15, wherein said key can be accessed and/or manipulated without the use of an external tool.

18. The magazine lock of claim 15, wherein said key can only be accessed and/or manipulated by rendering said firearm inoperable.

19. The magazine lock of claim 15, wherein said key automatically disengages from said magazine catch by rendering said firearm inoperable.

20. The magazine lock of claim 15, wherein said key can be selectively placed in either an engaged state or in a disengaged state with said magazine catch.

21. A magazine lock for a firearm, the firearm having a lower portion/receiver, the lower portion/receiver having a magazine well for corralling a magazine;

said magazine lock comprising:

a magazine catch extending into said magazine well, having a relief that is in communication with the interior of said magazine well;

a key movably mounted to the interior of said magazine well, extending above said lower receiver, and having a portion that can selectively be inserted into or removed from said relief on said magazine catch;

whereby said key being present in said relief on said magazine catch prevents said magazine from being removed from said firearm;

whereby said key being absent from said relief on said magazine catch permits said magazine to be removed from said firearm.

* * * * *